US005690196A

United States Patent [19]

Wang

[11] Patent Number: 5,690,196

[45] Date of Patent: Nov. 25, 1997

[54] RETRACTABLE HANDLE ASSEMBLY FOR A SUITCASE

[76] Inventor: Jin-jiao Wang, No. 18, Lane 116, Ta An Gan Rd., Tachia Chen, Taichung Hsien, Taiwan

[21] Appl. No.: 695,693

[22] Filed: Aug. 12, 1996

[51] Int. Cl.[6] ..... A45C 5/14; A45C 13/26

[52] U.S. Cl. ..... 190/115; 190/18 A; 190/39; 16/112; 16/115

[58] Field of Search ..... 190/39, 115, 18 R; 16/115, 112; 280/37, 655, 655.1, 47.315

[56] References Cited

U.S. PATENT DOCUMENTS

| | | | |
|---|---|---|---|
| 5,323,887 | 6/1994 | Scicluna et al. | 190/115 X |
| 5,330,037 | 7/1994 | Wang | 190/115 X |
| 5,464,081 | 11/1995 | Zwanzig | 190/115 |
| 5,469,945 | 11/1995 | Jserng | 190/115 |
| 5,491,872 | 2/1996 | Tserng | 190/115 X |
| 5,497,865 | 3/1996 | Yun-Pi | 16/115 X |
| 5,575,362 | 11/1996 | Franklin | 190/115 |

*Primary Examiner*—Sue A. Weaver
*Attorney, Agent, or Firm*—Martin Korn

[57] ABSTRACT

A retractable handle assembly includes a supporting bracket fixedly mounted on a top wall of a suitcase and including two end portions each having a socket vertically defined therein and a side extension wall extending downwardly from an underside thereof. Two receiving casings are each fixedly mounted on the side extension wall of the supporting bracket and each communicate with each of the two sockets. Two rotary cylinders are each rotatably received in a corresponding one of the two receiving casings and each have a passage radially defined therein and aligning with an associated socket. A U-shaped handle includes two upright legs each movably mounted on the supporting bracket and each slidably extending through a corresponding one of the two sockets and an associated passage. A handgrip has two distal ends each having a sleeve extending downwardly therefrom and fixedly mounted on an upper end of a corresponding one of the two upright legs.

7 Claims, 7 Drawing Sheets

RETRACTABLE HANDLE ASSEMBLY FOR A SUITCASE

FIELD OF THE INVENTION

The present invention relates to a retractable handle assembly for a suitcase.

BACKGROUND OF THE INVENTION

A conventional handle assembly for a suitcase comprises two retractable handles slidably mounted on the suitcase and a cross handgrip mounted between the two retractable handles for facilitating a user's hands to hold the cross handgrip.

By such an arrangement, however, the handgrip has a determined length without any retractability such that it is suitable for a single user only, thereby limiting the usage of the handle assembly.

In addition, the two retractable handles are limited to slide in the suitcase only and cannot not be pivoted relative to the suitcase, that is, an included angle defined between each of the two handles and the suitcase is fixed constant and cannot be adjusted, thereby greatly limiting the adjustability of the handle assembly.

The present invention has arisen to mitigate and/or obviate disadvantages of the conventional handle assembly.

SUMMARY OF THE INVENTION

In accordance with one aspect of the present invention, there is provided a retractable handle assembly for a suitcase and the like.

The handle assembly comprises a supporting bracket fixedly mounted on a wall of the suitcase and including two end portions each having a socket vertically defined therein and a side extension wall extending downwardly from an underside thereof.

Two receiving casings are each fixedly mounted on the side extension wall of the supporting bracket and each communicate with each of the two sockets. Two rotary cylinders are each rotatably-received in a corresponding one of the two receiving casings and each have a passage radially defined therein and aligning with an associated socket.

A U-shaped handle includes two upright legs each movably mounted on the supporting bracket and each slidably extending through a corresponding one of the two sockets and an associated passage. A handgrip has two distal ends each having a sleeve extending downwardly therefrom and fixedly mounted on an upper end of a corresponding one of the two upright legs.

Further features of the present invention will become apparent from a careful reading of the detailed description provided hereinbelow, with appropriate reference to the accompanying drawings.

DETAILED DESCRIPTION OF THE PREFERRED EMBODIMENTS

Figure 1:
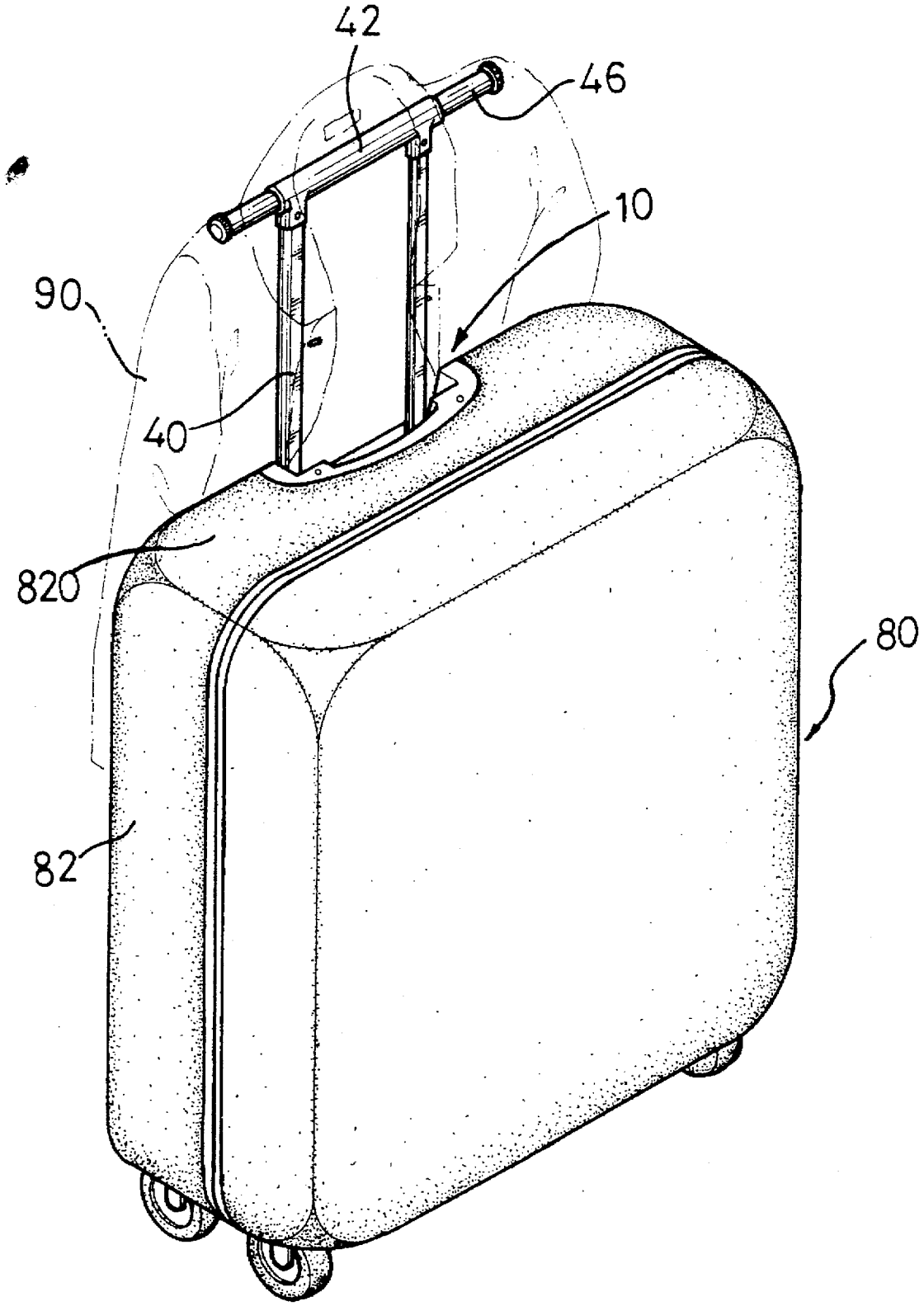
FIG. 1 is a front perspective view of a suitcase in accordance with the present invention.
Figure 2:
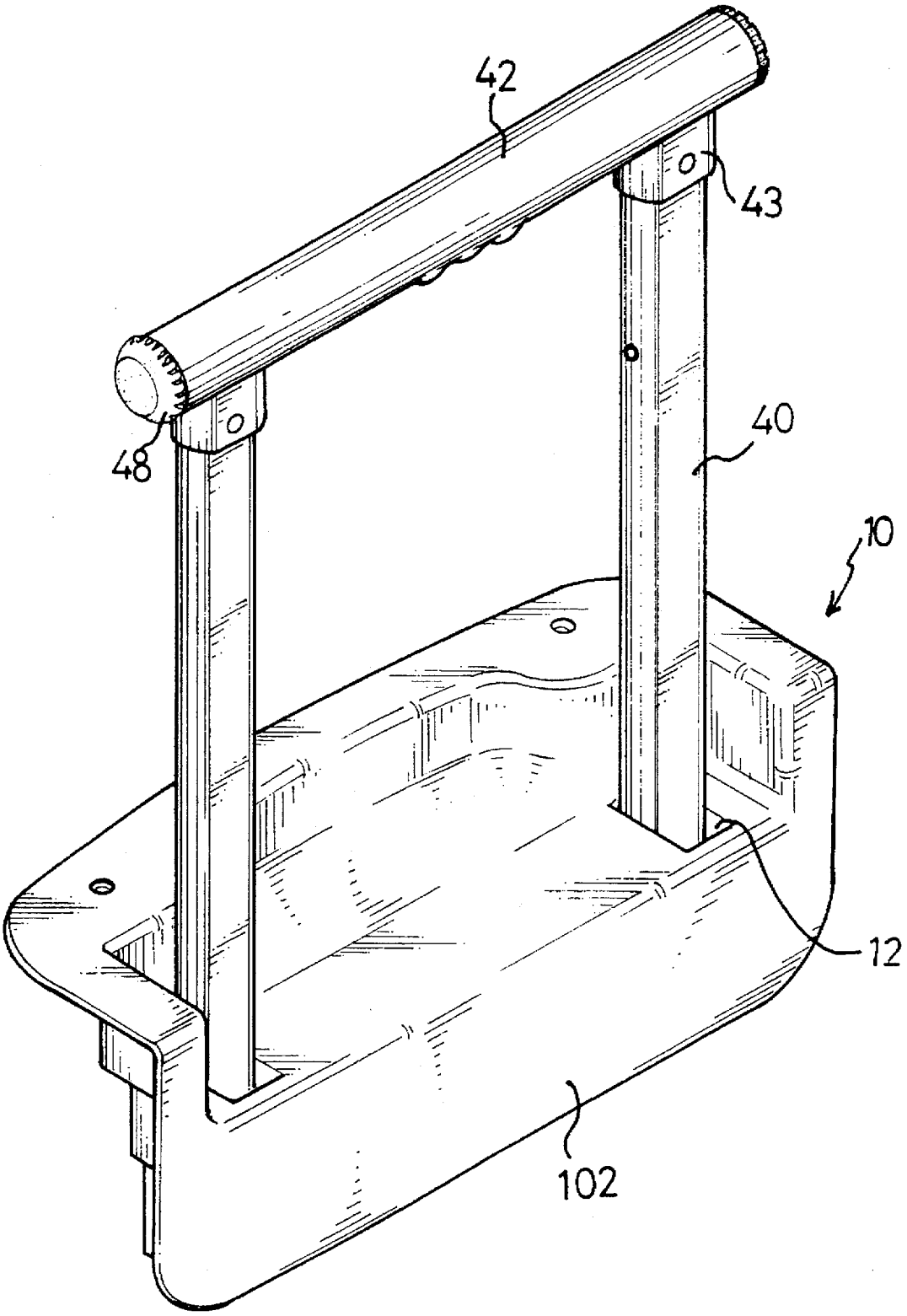
FIG. 2 is a rear perspective view of a retractable handle assembly for the suitcase in accordance with the present invention.
Figure 3:
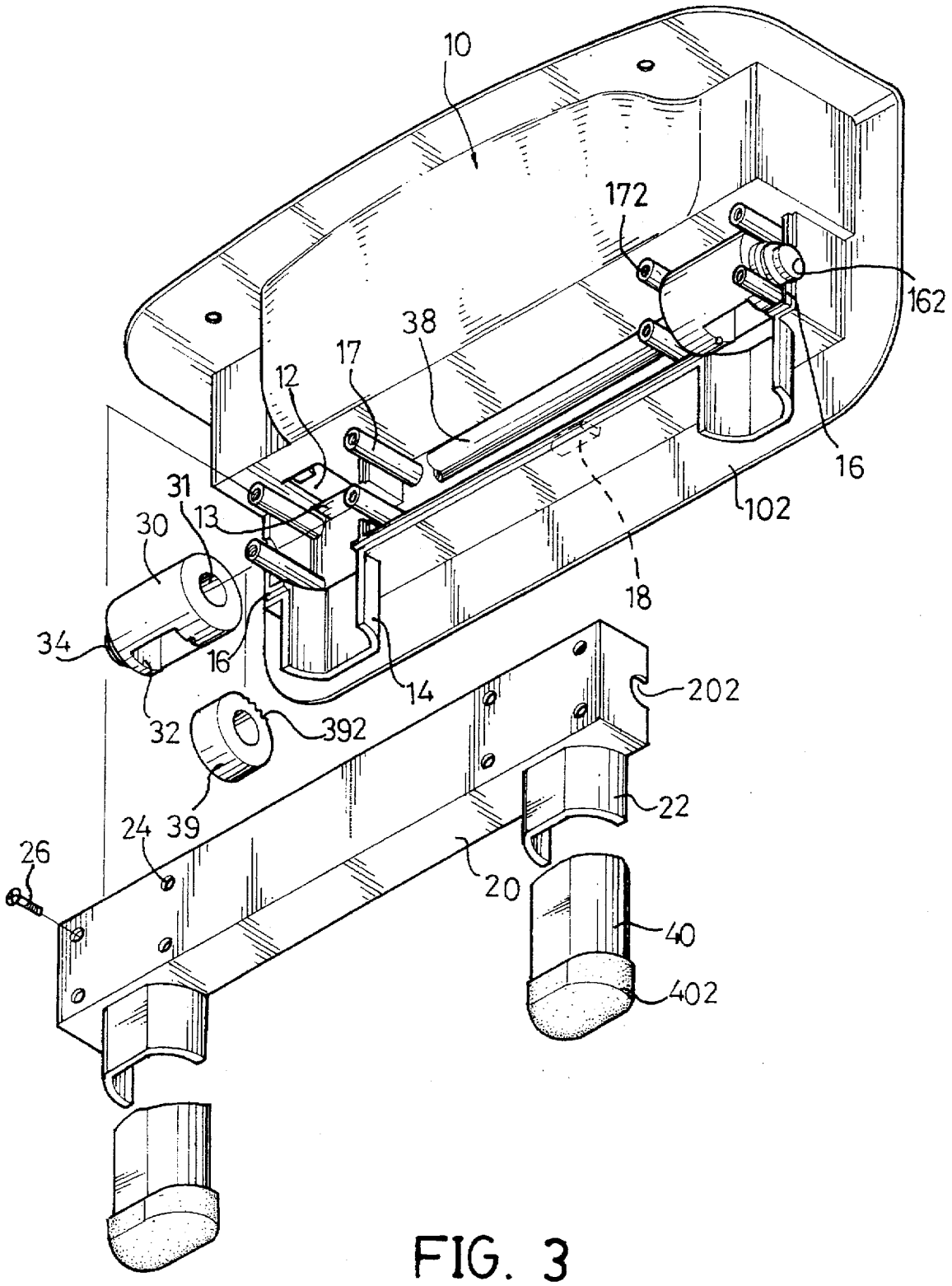
FIG. 3 is a bottom exploded view of FIG. 2.

Referring to the drawings, and initially to FIGS. 1–3, a retractable handle assembly in accordance with the present invention is provided for a suitcase 80 comprising two half bodies 82 engageable with each other and each having a top wall 820.

The handle assembly comprises a supporting bracket 10 fixedly mounted on the top wall 820 of one of the half bodies of the suitcase 80 and including two end portions each having a socket 12 vertically defined therein and a side extension wall 102 extending downwardly from an underside thereof. The side extension wall 102 has two stop ramps 13 each disposed in a corresponding one of the two sockets 12.

Two receiving casings 16 are each fixedly mounted on the side extension wall 102 of the supporting bracket 10 and each communicate with each of the two sockets 12. Two rotary cylinders 30 are each rotatably received in a corresponding one of the two receiving casings 16 and each have a passage 32 radially defined therein and aligning with an associated socket 12.

A U-shaped handle includes two upright legs 40 each movably mounted on the supporting bracket 10 and each slidably extending through a corresponding one of the two sockets 12 and an associated passage 32. A handgrip 42 has two distal ends each having a sleeve 43 extending downwardly therefrom and fixedly mounted on an upper end of a corresponding one of the two upright legs 40.

A linking rod 38 is mounted between the two rotary cylinders 30 and has two distal ends each fixedly fitted in a recess 31 defined in each of the two rotary cylinders 30. A retaining member 39 is fixedly mounted around the linking rod 38 and has a plurality of teeth 392 formed on a periphery thereof and meshing with a catch 18 formed on the side extension wall 102 of the supporting bracket 10 (see FIG. 5).

Each of the two receiving casings 16 has a first semicircular cavity 162 defined therein. A receiving cap 20 has two end portions each fixedly mounted on a corresponding one of the two receiving casings 16 and each having a second semi-circular cavity 202 defined therein and aligning with an associated first semi-circular cavity 162. Each of the two rotary cylinders 30 has a stub 34 protruding from one end thereof and received by associated first and second semicircular cavities 162 and 202.

A plurality of posts 17 are horizontally formed on the side extension wall 102 and each have a bore 172 defined by an inner threaded wall thereof. The receiving cap 20 has a plurality of holes 24 defined therein and each aligning with each of the bores 172. A plurality of positioning bolts 26 each extend through each of the respective holes 24 and are each threadedly engaged in each of the respective bores 172, thereby fitting the receiving cap 20 on the two receiving casings 16.

Each of the two receiving casings 16 has a first half tube 14 extending downwardly and located under an associated rotary cylinder 30. Each of the two end portions of the receiving cap 20 includes a second half tube 22 extending downwardly and engaged with an associated first half tube 14. Each of the two legs 40 has a lower portion with an enlarged stop 402 which can slide in an assembly of the first and second half tubes 14 and 22 and is stopped by an associated rotary cylinder 30.

Figure 4:
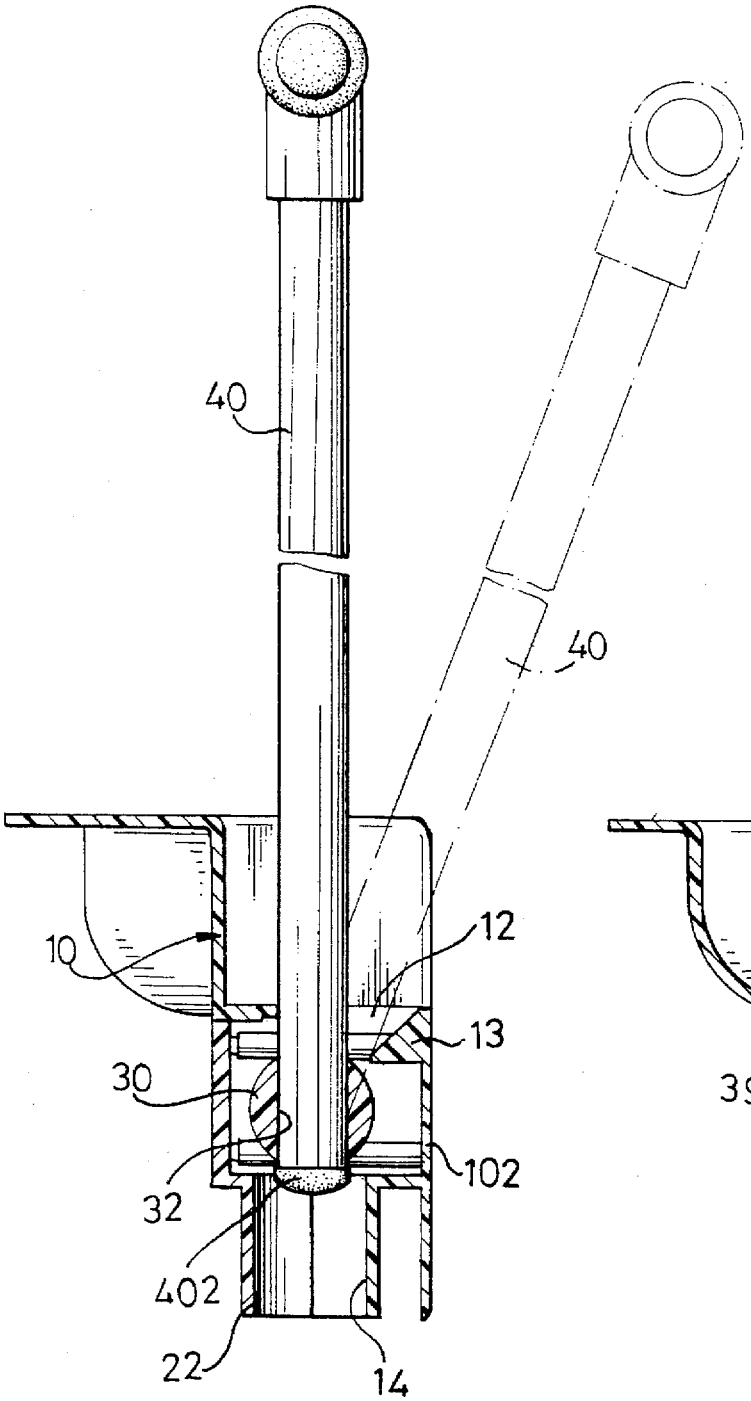
FIGS. 4 and 5 are side cross-sectional operational assembly views of FIG. 3.
Figure 5:
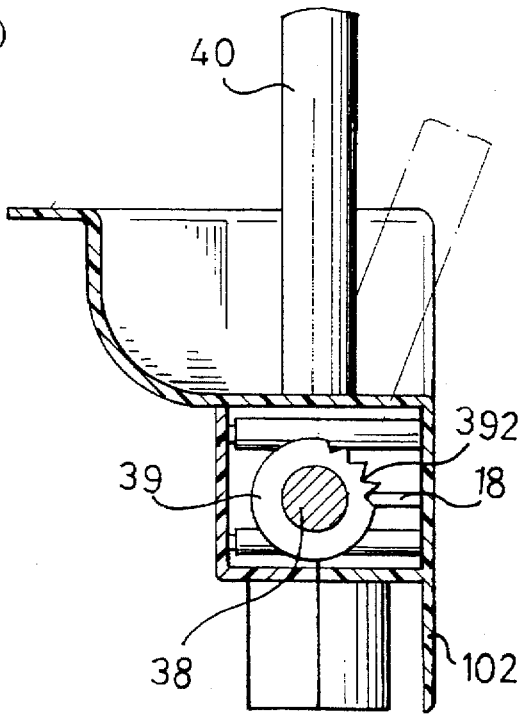

In operation, referring to FIGS. 4 and 5 with reference to FIGS. 1–3, each of the two legs 40 is slidable in the socket 12 of the supporting bracket 10, the passage 32 of the rotary cylinder 30 and the assembly of the first and second half tubes 14 and 22.

When each of the two legs 40 is elevated to an uppermost position as shown in FIG. 4 with the enlarged stop 402 limited by the rotary cylinder 30, each of the legs 40 together with the rotary cylinder 30 can be rotated relative to the supporting bracket 10 to a position as shown in phantom lines. Each of the stop ramps 13 functions to limit a further rotation of each of the legs 40.

At the same time, the retaining member 39 preferably made of a resilient material can be rotated by the linking rod 38. The rotational movement of the retaining member 39 is limited by means of a detachable engagement between the plurality of teeth 392 and the catch 18 as shown in FIG. 5, thereby providing a temporary positioning effect on the rotational movement of each of the legs 40 together with the associated rotary cylinder 30.

Figure 6:
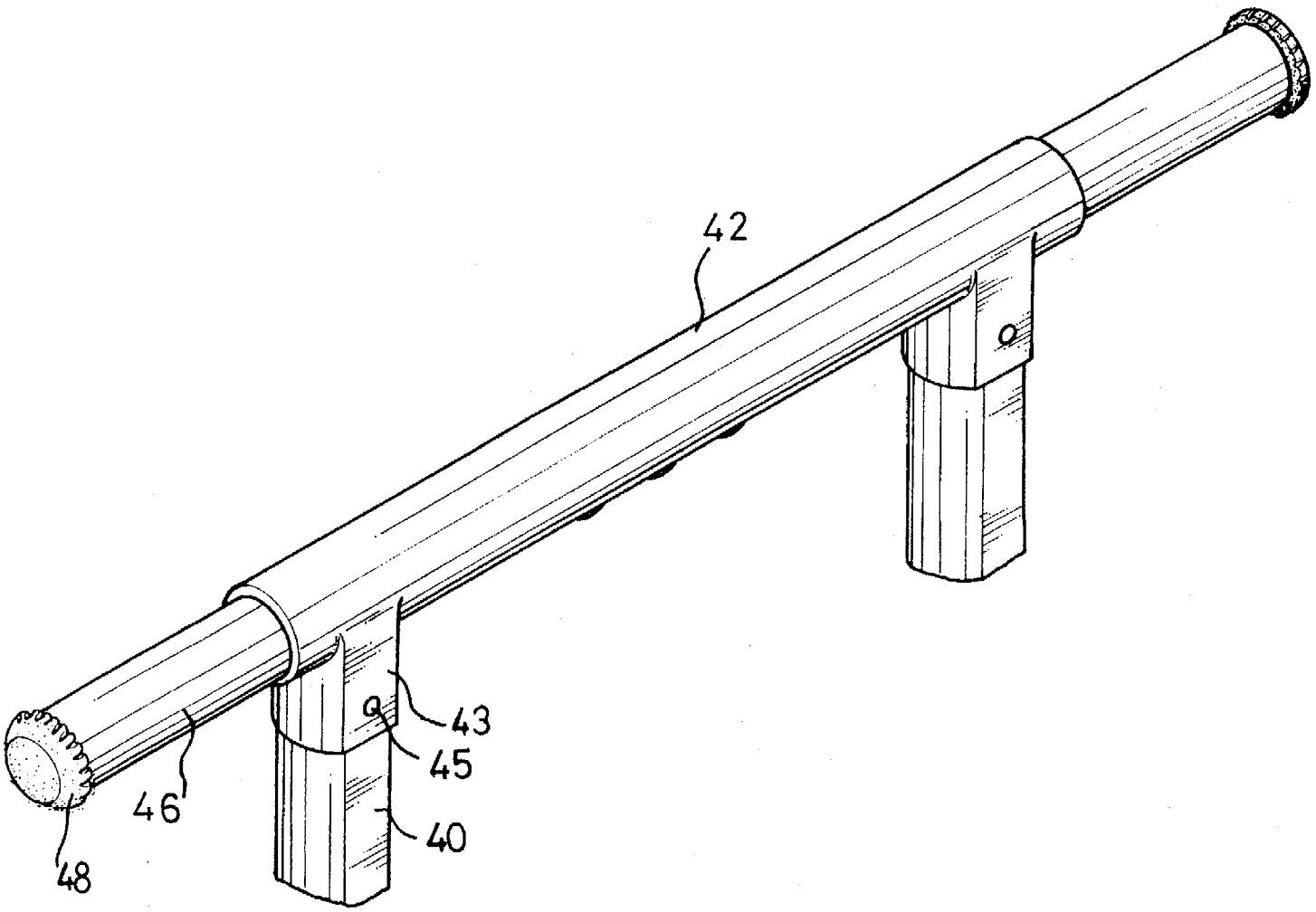
FIG. 6 is a perspective view showing an assembly of a handgrip, two handles and two retractable tubes.
Figure 7:
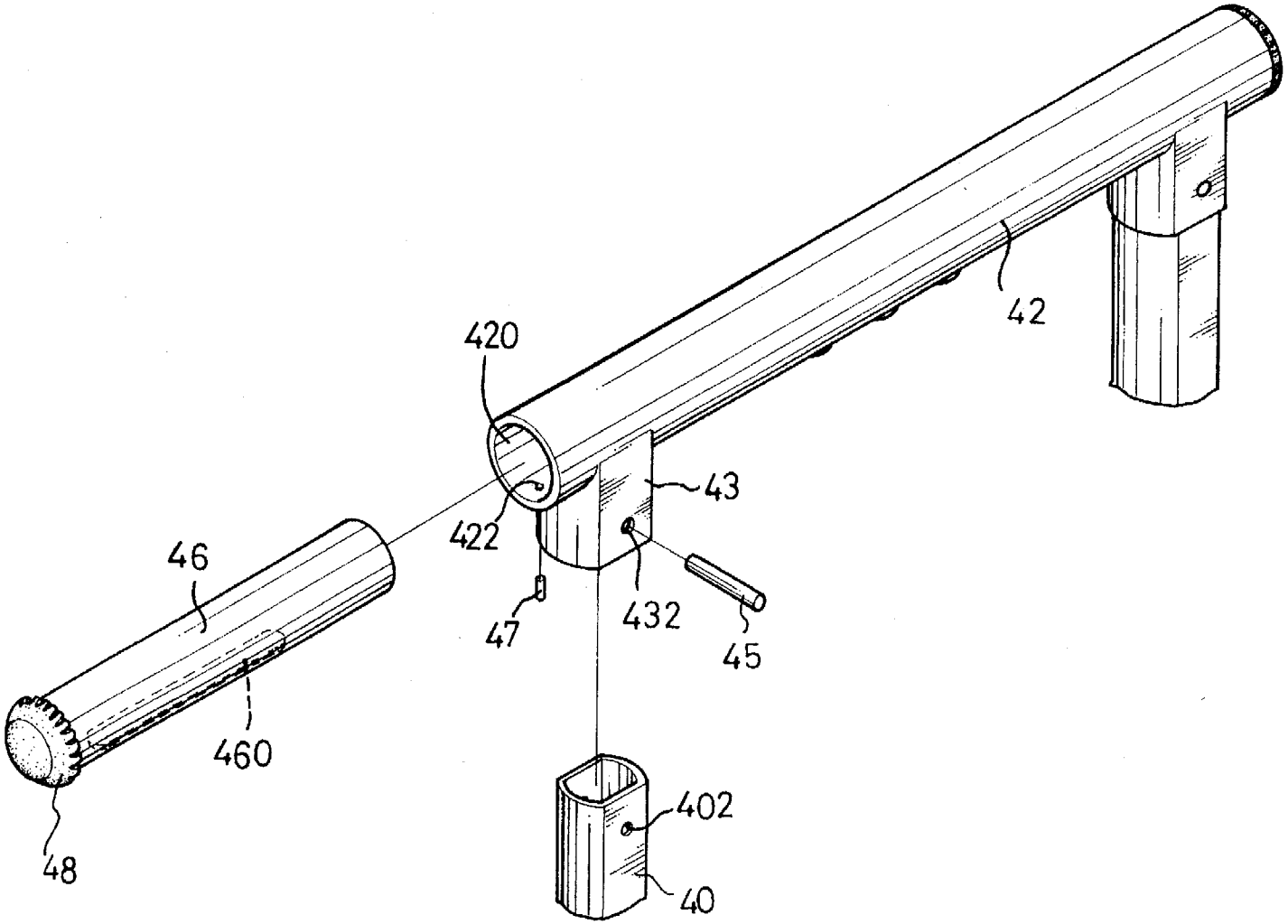
FIG. 7 is a partially exploded view of FIG. 6.
Figure 8:
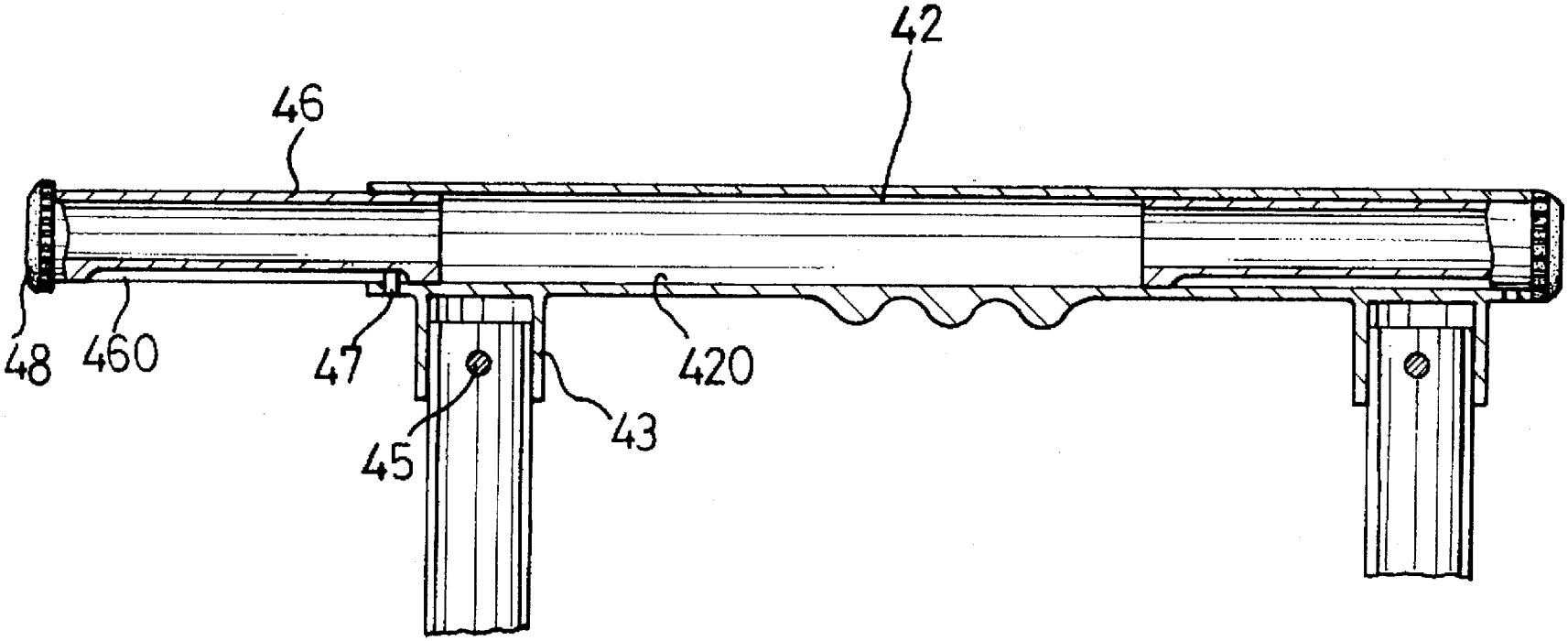
FIG. 8 is a front plan cross-sectional assembly view of FIG. 7.

Referring to FIGS. 6–8 with reference to FIG. 2, two positioning pins 45 each extend through a hole 432 defined in each of the two sleeves 43 and through a bore 402 defined in the upper end of each of the two legs 40, thereby fixing the handgrip 42 on the two legs 40.

Two retractable tubes 46 are each slidably mounted on each of the two distal ends of the handgrip 42 and are each received in a channel 420 longitudinally defined in the handgrip 42. Each of the two retractable tubes 46 has an enlarged head 48 mounted on one distal end thereof.

Two retaining pins 47 each extend through a hole 422 defined in each of the two distal ends of the handgrip 42 and are each received in an elongate slot 460 defined in each of the two retractable tubes 46, thereby preventing each of the two retractable tubes 46 from escaping from the handgrip 42.

Referring to FIG. 1, clothing 90, such a jacket etc. can be suspended on the two retractable tubes 46 when they are fully extended.

It should be clear to those skilled in the art that further embodiments of the present invention may be made without departing from the spirit and scope of the present invention.

What is claimed is:

1. A retractable handle assembly for a suitcase (80) having a top wall (820), said handle assembly comprising:

a supporting bracket (10) fixedly mounted on said top wall (820) of said suitcase (80) and including two end portions each having a socket (12) vertically defined therein and a side extension wall ( 102 ) extending downwardly from an underside thereof, said supporting bracket (10) further including a catch (18) formed on said side extension wall (102);

two receiving casings (16) each fixedly mounted on said side extension wall (102) of said supporting bracket (10) and each communicating with a of said two sockets (12);

two rotary cylinders (30) each rotatably received in a corresponding one of said two receiving casings (16) and each having a passage (32) radially defined therein and aligning with an associated socket (12);

a linking rod (38) mounted between said two rotary, cylinders (30) and having two distal end each fixedly fitted in a corresponding one of said two rotary, cylinders (30), at least one retaining member (39) fixedly mounted around said linking rod (38) and having a plurality of teeth (392) formed on a periphery thereof for meshing with said catch (18);

a U-shaped handle including two upright legs (40) each movably mounted on said supporting bracket (10) and each slidably extending through a corresponding one of said two sockets (12) and a corresponding passage (32) of said two rotary, cylinders (30); and a handgrip (42) having two distal ends each having a sleeve (43) extending downwardly therefrom and fixedly mounted on an upper end of a corresponding one of said two upright legs (40).

2. The handle assembly in accordance with claim 1, wherein each of said two receiving casings (16) has a first semi-circular cavity (162) defined therein, a receiving cap (20) having two end portions each fixedly coupled with a corresponding one of said two receiving casings (16) and each having a second semi-circular cavity (202) defined therein and aligning with a corresponding one of said first semi-circular cavity (162), each of said two rotary cylinders (30) having a stub (34) protruding from one end thereof and retained by said first and second semi-circular cavities (162) and (202), said handle assembly further including means for fixedly coupling said receiving cap (20) to said two receiving casings ( 16).

3. The handle assembly in accordance with claim 2, wherein each of said two receiving casings (16) has a first half tube (14) extending downwardly and located under an associated said rotary cylinder (30), each of the two end portions of said receiving cap (20) having a second half tube (22) extending downwardly and engaged with an associated said first half tube (14), each of said two legs (40) having an enlarged lower portion (402) slidably mounted in an assembly of said first and second half tubes (14) and (22) and stopped by an associated said rotary cylinder (30).

4. The handle assembly in accordance with claim 1, wherein the side extension wall (102) of said supporting bracket (10) has two stop ramps (13) each disposed in a corresponding one of said two sockets (12).

5. The handle assembly in accordance with claim 1, further comprising two retractable tubes (46) each slidably mounted in each of the two distal ends of said handgrip (42).

6. A retractable handle assembly for a suitcase (80) having a top wall (820), said handle assembly comprising:

a supporting bracket (10) fixedly mounted on said top wall (820) of said suitcase (80) and including two end portions each having a socket (12) vertically defined therein and a side extension wall (102) extending downwardly from an underside thereof;

two receiving casings (16) each fixedly mounted on said side extension wall (102) of said supporting bracket (10) and each communicating with a corresponding one of said two sockets (12);

two rotary cylinders (30) each rotatably received in a corresponding one of said two receiving casings (16) and each having a passage (32) radially defined therein and aligning with an associated socket (12);

a U-shaped handle including two upright legs (40) each movably mounted on said supporting bracket (10) and each slidably extending through a corresponding one of said two sockets (12) and a corresponding passage (32) of said two rotary cylinders (30);

a handgrip (42) having two distal ends each having a sleeve (43) extending downwardly therefrom and fixedly mounted on an upper end of a corresponding one of said two upright legs (40); and each of said two receiving casings (16) has a first semi-circular cavity (162) defined therein, a receiving cap (20) having two end portions each fixedly coupled with a corresponding one of said two receiving casings (16) and each having a second semi-circular cavity (202) defined therein and aligning with a corresponding one of said first semi-circular cavity (162), each of said two rotary cylinders (30) having a stub (34) protruding from one end thereof and retained by said first and second semicircular cavities (162) and (202), said handle assembly further including means for fixedly coupling said receiving cap (20) to said two receiving casings (16).

7. The handle assembly in accordance with claim 6, wherein each of said two receiving casings (16) has a first half tube (14) extending downwardly and located under an associated rotary cylinder (30), each of the two end portions of said receiving cap (20) having a second half tube (22) extending downwardly and engaged with an associated first half tube (14), each of said two legs (40) having an enlarged lower portion (402) slidably mounted in an assembly of said first and second half tubes (14) and (22) and stopped by an associated rotary cylinder (30).

* * * * *